US010710689B1

(12) United States Patent
Young

(10) Patent No.: US 10,710,689 B1
(45) Date of Patent: Jul. 14, 2020

(54) POWER GENERATION METHOD AND DEVICE

(76) Inventor: William Dwight Young, San Jose, CA (US)

( * ) Notice: Subject to any disclaimer, the term of this patent is extended or adjusted under 35 U.S.C. 154(b) by 2198 days.

(21) Appl. No.: 12/008,915

(22) Filed: Jan. 14, 2008

(51) Int. Cl.
*B63H 1/38* (2006.01)

(52) U.S. Cl.
CPC ..... *B63H 1/38* (2013.01)

(58) Field of Classification Search
USPC ..... 415/3.1, 4.1, 4.3, 4.5, 906, 908, 7; 416/84, 85; 28/42, 53
See application file for complete search history.

(56) References Cited

U.S. PATENT DOCUMENTS

| | | | | | |
|---|---|---|---|---|---|
| 1,360,596 | A | * | 11/1920 | St John | 416/84 |
| 1,898,973 | A | | 2/1933 | Lansing | |
| 2,501,696 | A | * | 3/1950 | Souczek | 290/43 |
| 3,092,060 | A | * | 6/1963 | Reid | 114/313 |
| 3,209,156 | A | | 9/1965 | Struble, Jr. | 290/54 |
| 3,352,271 | A | * | 11/1967 | Watari | 114/74 R |
| 3,830,178 | A | * | 8/1974 | Lang | 114/61.14 |
| 3,958,598 | A | * | 5/1976 | Schneider et al. | 137/596.18 |
| 3,980,894 | A | | 9/1976 | Vary et al. | 290/54 |
| 3,999,499 | A | | 12/1976 | Kitabayashi | 114/244 |
| 4,102,291 | A | | 7/1978 | Sebald | 114/244 |
| 4,147,472 | A | * | 4/1979 | Kling | 416/193 R |
| 4,301,377 | A | * | 11/1981 | Rydz | F03B 17/063 290/43 |
| 4,383,182 | A | | 5/1983 | Bowley | 290/43 |
| 4,415,306 | A | * | 11/1983 | Cobden | 415/4.5 |
| 4,450,364 | A | * | 5/1984 | Benoit | F03D 9/25 290/55 |
| 4,648,342 | A | * | 3/1987 | Collins et al. | 114/40 |
| 4,717,832 | A | * | 1/1988 | Harris | 290/43 |
| 4,737,070 | A | * | 4/1988 | Horiuchi et al. | 415/7 |
| 4,849,647 | A | * | 7/1989 | McKenzie | 290/54 |
| 5,946,909 | A | * | 9/1999 | Szpur | 60/398 |
| 6,091,161 | A | * | 7/2000 | Dehlsen et al. | 290/43 |
| 6,168,373 | B1 | * | 1/2001 | Vauthier | 415/7 |
| 6,531,788 | B2 | | 3/2003 | Robson | 290/43 |
| 6,537,018 | B2 | | 3/2003 | Streetman | 415/3.1 |

(Continued)

FOREIGN PATENT DOCUMENTS

| | | | |
|---|---|---|---|
| GB | 24808 | * | 4/1909 |
| JP | 2002257023 A | * | 9/2002 |

OTHER PUBLICATIONS

Pelamis Wave Power, "Pelamis P-750 Wave Energy Converter", www.pelamiswave.com, Pelamis Wave Power 104 Commercial Street, Edinburg EH6 6NF, UK.

(Continued)

*Primary Examiner* — Woody A Lee, Jr.
*Assistant Examiner* — Michael L Sehn
(74) *Attorney, Agent, or Firm* — Haverstock & Owens LLP

(57) ABSTRACT

A power generation method and device utilizes fluid currents to generate power by rotating a rotation element which in turn rotates a cable which turns components within a power generator to generate the power. The rotation element is positioned within the fluid and is able to move to different depths as desired. The power generator is positioned inside or outside of the fluid. The rotation element is able to be a helix, helix-propeller, propeller or any other practical design. The rotation element is also able to implement additional components.

20 Claims, 9 Drawing Sheets

(56) References Cited

U.S. PATENT DOCUMENTS

| | | | | |
|---|---|---|---|---|
| 6,849,963 | B2 | 2/2005 | Grinsted et al. | 290/42 |
| 7,011,501 | B2 * | 3/2006 | Lindberg | 416/84 |
| 7,105,942 | B2 | 9/2006 | Henriksen | 290/55 |
| 7,199,484 | B2 * | 4/2007 | Brashears | 290/54 |
| 7,525,214 | B2 * | 4/2009 | Atilano Medina | F03B 13/186 290/42 |
| 7,713,031 | B2 * | 5/2010 | Dane | 417/61 |
| 2001/0018279 | A1 * | 8/2001 | Ishikawa | 439/79 |
| 2006/0251510 | A1 | 11/2006 | Gray et al. | 415/121.2 |
| 2007/0007772 | A1 | 1/2007 | Brashears | 290/43 |
| 2007/0057515 | A1 * | 3/2007 | Daniels | 290/44 |
| 2007/0063520 | A1 | 3/2007 | Ahmad | 290/54 |
| 2008/0298962 | A1 * | 12/2008 | Sliwa | 416/31 |
| 2009/0021012 | A1 * | 1/2009 | Stull | F03D 9/28 290/44 |

OTHER PUBLICATIONS

Associated Press, Tidal Energy Companies Staking Claim on Tracts of Water, Nov. 6, 2006, http://www.foxnews.com/story/0,2933,227745,00:html.
Jeannette J Lee, Water Turbines Use Waves for Energy, Nov. 6, 2006, San Jose Mercury News.
Stainless-Steel Rigging, p. 44, The West Advisor.
Samson, www.samsonrope.com, 2004.
John Shelton, Inc., Site Development Solutions, Sep. 2007, www.contech-cpi.com.
Praxair, www.praxair.com/specialtygases.
Praktek, Inc., Inflatable Fenders, www.praktek.com/fenders.
Gunnebo Johnson, www.gunnebojohnson.com.
Walker Bay, www.walkerbaygenesis.com.
Underwater Intervention, ON&T Aug./Sep. 2007, vol. 13, Issue 6, p. 52.
Ocean Monitoring & Measuring Instruments; Flotation—July Buyers Guide, ON&T Jul. 2007, vol. 13, Issue 5, p. 19.
LinkQuest Inc., www.link-quest.com.
SonTek/YSI in Action, Argonaut-MD Used in Stingray Generator Farm, www.sontek.com, Jun. 2006.
The SeaSonde, www.codaros.com.
Teledyne RD Instruments, Marine Measurements Product Overview Guide, www.rdinstruments.com, 2007.
Hyrdophones, www.bethos.com.
Telesonar, www.bethos.com, 2005.
Innovative FSO Mooring System, ON&T Oct./Nov. 2007, vol. 13, Issue 7, p. 26.
DMT Purchases State-of-the-Art Pilot Training Simulator, ON&T Dec. 2007, vol. 13, Issue 8, p. 44.
Argonaut-MD, Specifications, www.sontek.com.
Workhorse Waves Array, www.rdinstruments.com.
Jon D. Wood and Dr. Eugene A. Terray, Measuring Ocean Waves and Currents in Deep Water, Feb. 2007, Sea Technology.
Evo Logistics, S2C Hyrdoaccoustic Modems.
ANCRA International LLC, "Cargo Systems Division Headquarters", Ancra Cincinnati, www.ancra.com.

* cited by examiner

POWER GENERATION METHOD AND DEVICE

FIELD OF THE INVENTION

The present invention relates to the field of power generation. More specifically, the present invention relates to the field of power generation utilizing a generator in flowing water.

BACKGROUND OF THE INVENTION

Conventional power sources such as natural gas and oil are being rapidly depleted throughout the world. Alternative sources such as natural fluid streams or currents are presently under investigation since such sources are readily available and inexhaustible.

Flowing water has from five to six times as much capacity for electrical generation as does wind power, not including the twenty-four hour steady nature of the water-derived generation. Wind farms pay taxes on considerable tracts of land, have extensive buried cable requirements on site and substantial cable runs to a grid connection. Their generators are spaced at large intervals to provide undisturbed wind streams and blade clearance. They suffer from the on and off nature of wind, high service costs associated with "off the ground" equipment and various environmental and aesthetic problems, all of which reduce cost effectiveness.

The prior art discusses many devices and methods for converting the energy contained in natural fluid streams, such as the wind and the tides, into usable electric power. Turbines driven by the flow of trapped tidal waters are an example of turning energy in a natural fluid stream into electric power. Prior attempts to convert such energy have usually failed for a number of reasons. The cost of the apparatus to convert the energy stored in a natural flowing stream has typically been prohibitive. Further, tidal warming wind motion is unpredictable in nature and an apparatus must be provided to restore energy during peak periods of wave and wind activity for later use.

There are several apparatuses and methods that attempt to harness energy from water current flow; however, all of these prior art have significant differences, limitations or drawbacks.

SUMMARY OF THE INVENTION

A power generation method and device utilizes fluid currents to generate power by rotating a rotation element which in turn rotates a cable which turns components within a power generator to generate the power. The rotation element is positioned within the fluid and is able to move to different depths as desired. The power generator is positioned primarily inside of the fluid. In some embodiments, the power generator is positioned partially outside of the fluid. The rotation element is able to be a helix, helix-propeller, propeller or any other practical design.

In one aspect, an apparatus for generating power comprises a body, one or more blades which rotate the body in a fluid in reaction to movement of the fluid and a buoyancy control mechanism within the body to alter a depth of the body in the fluid. The body and the one or more blades are able to be fluid-inflatable. The buoyancy control mechanism utilizes weights to alter the depth of the body. Alternatively, the buoyancy control mechanism utilizes a compressed gas reservoir surrounded by a segregated bladder to alter the depth of the body. The apparatus further comprises one or more valves within the buoyancy control mechanism to alter the depth of the body in the fluid. The one or more valves are remotely controlled. A reserve buoy coupled to the body activated remotely for recovery. The apparatus further comprises an anchor sometimes for submerging the body. The body is coupled to a power generator positioned outside of the fluid. The body is coupled to a cable attachment which contains a clutch arrangement for engaging and disengaging the body, the cable attachment further for holding and moving the body while the body is in a rotating mode. A size of the body is adjustable.

In another aspect, a system for generating power comprises a power generator for generating power positioned outside of a fluid and a first rotation element coupled to the power generator with a first cable, the first rotation element for rotating the first cable due to a motion of the fluid the first rotation element is submerged in, wherein a depth of the first rotation element is modifiable using a first buoyancy control mechanism. The system further comprises a second rotation element coupled to the power generator with a second cable, the second rotation element for rotating the second cable due to the motion of the fluid the second rotation element is submerged in, wherein the depth of the second rotation element is modifiable using a second unified buoyancy control mechanism, further wherein the first rotation element is left-hand rotation and the second rotation element is right-hand rotation. The body and the rotation element is fluid-inflatable. The buoyancy control mechanism utilizes a compressed gas reservoir surrounded by a segregated bladder to alter the depth of the first rotation element. The system further comprises one or more valves within the buoyancy control mechanism to alter the depth of the first rotation element in the fluid. The one or more valves are remotely controlled. The system further comprises a reserve buoy and line coupled to the first rotation element activated remotely for recovery. The first rotation element is coupled to a cable attachment which contains a bearing swivel safety hook for engaging and disengaging the first rotation element, the cable attachment further for holding and moving the first rotation element while the first rotation element is in a rotating mode.

In another aspect, a method of generating power comprises inserting one or more rotation elements into a fluid, positioning the one or more rotation elements in the fluid at a desired depth using a buoyancy control mechanism and rotating the one or more rotation elements in the fluid which rotate a cable coupled to a power generator positioned outside of the fluid. A separate clutch exists to control the elements.

In yet another aspect, a network of devices for generating power comprises one or more floating members, one or more power generators positioned on the one or more floating members, the one or more power generators for generating power and one or more rotation elements coupled to the one or more power generators with one or more cables, the one or more rotation elements for rotating the one or more cables due to a motion of a fluid the one or more rotation elements are submerged in, wherein a depth of the one or more rotation elements is modifiable using a buoyancy control mechanism.

DETAILED DESCRIPTION OF THE PREFERRED EMBODIMENT

A power generation method and device enable using water or other fluid currents to generate electricity. In some embodiments, a cable or cables are deployed spanning the water course shore to shore or as desirable. Floating docks and/or boats are coupled to the cables, and power generators are positioned on the docks and/or boats. Rotation elements are coupled to the power generators, and the rotation elements are driven by the flowing water. In some embodiments, the electrical generation equipment and wiring is above the water, in a dry and protected condition, coupled to an existing electrical distribution grid. Each rotation element is able to be any appropriate and reasonable shape including, but not limited to, helical, helical-propeller, propeller only or water-wheel.

Figure 1A:
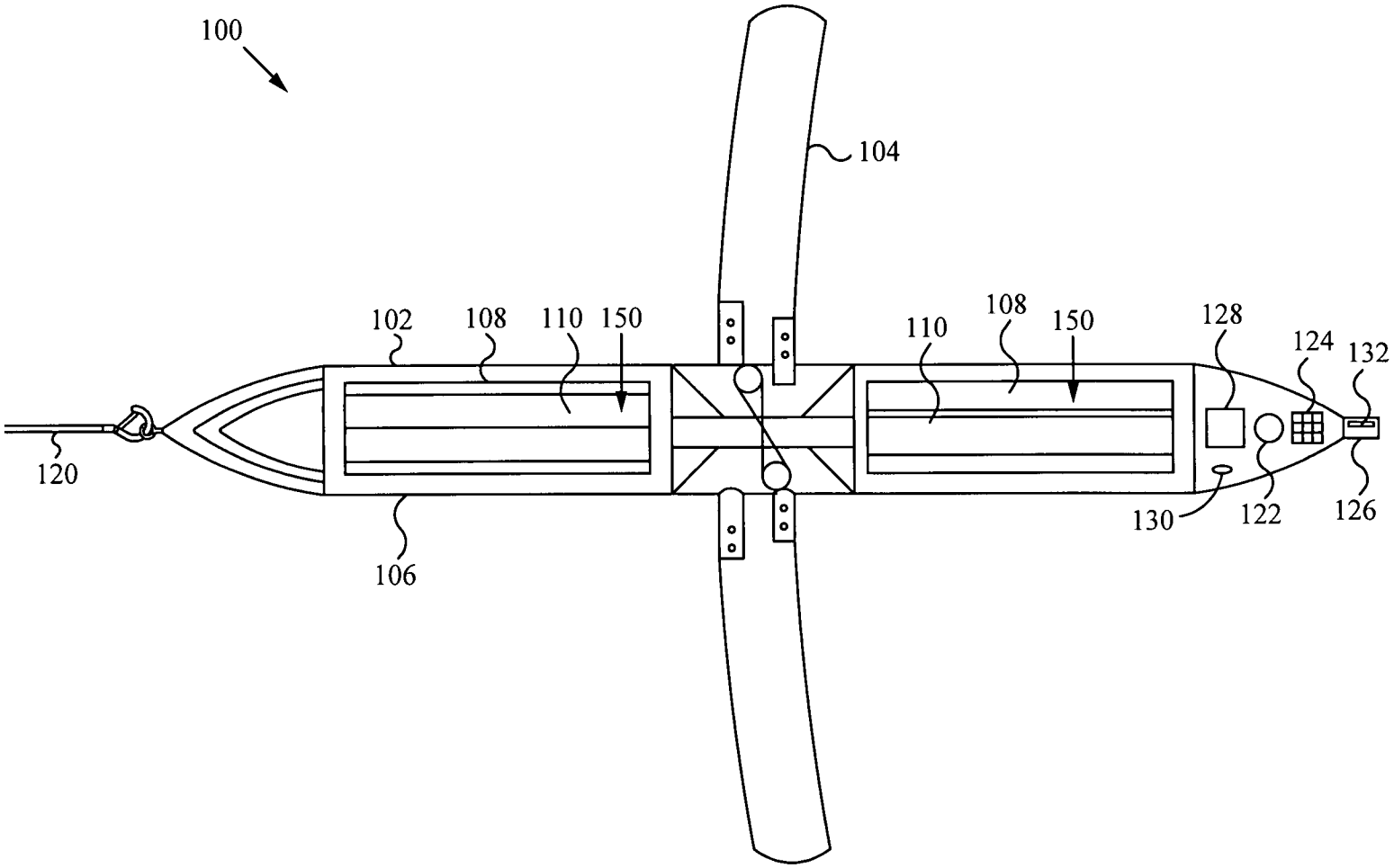
FIG. 1A illustrates a side view of a rotation element of an embodiment in accordance with the apparatus of the present invention.
Figure 1B:
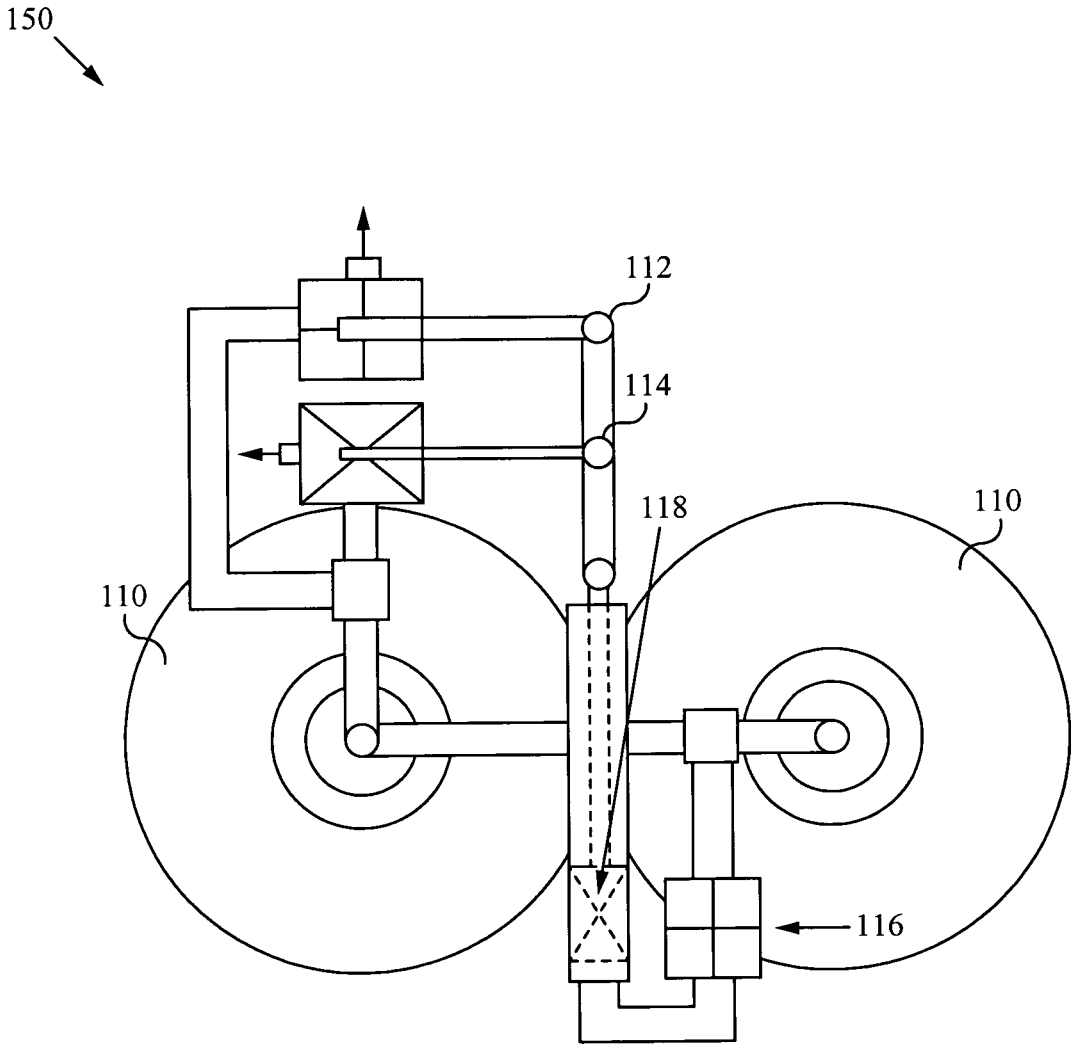
FIG. 1B illustrates a front view of a buoyancy control system.

FIG. 1A illustrates a side view of a rotation element 100 of an embodiment in accordance with the apparatus of the present invention. The rotation element 100 includes a body 102 and one or more blades 104 in a demountable condition. In some embodiments, for easy transport and assembly, the blades are coupled to the body 102 with simple fasteners such as bolts. The body 102 includes an outer shell 106 and a buoyancy control system 150 which includes a compartmentalized bladder 108, one or more compressed gas/air tanks 110 and one or more valves 112, 114, 116 (FIG. 1B). The gas within the gas/air tanks 110 is able to be any gas such as air.

The compressed gas/air tanks 110 serve as a spine. The tank or tanks 110 are at least partially surrounded by the compartmentalized bladder 108 which through use of separate pressure valves 112, 114, 116 (FIG. 1B) maintain stability and depth control. The rotation element 100 is able to be programmed to operate at selected depths and is brought to the surface for servicing. A submerged rotation element 100 "hunts" by following shifts in local currents. Pressure valve settings compensate by not micromanaging the assigned depth. The valves 112, 114, 116 (FIG. 1B) are able to be automatic, manual, remotely controlled and/or programmed to alter depth and location. A gas insertion mechanism 126 allows gas to be added or removed from the gas/air tanks 110 as desired. In some embodiments, the gas/air tanks 110 are controlled separately. In some embodiments, the gas/air tanks 110 are positioned vertically with respect to each other, horizontally with respect to each other or one set of tanks 110 is vertical and the other set of tanks 110 is horizontal. In some embodiments, the gas insertion mechanism 126 holds a balloon 132 to be released to the surface as needed.

In some embodiments, the rotation element 100 also includes a remote control device 128. The remote control is able to be operated using any wired or wireless implementation such as radio frequency. The rotation element 100 includes a separate gas holder 122, in some embodiments. A line holder 124 is able to be included to store a line for retrieval of the rotation element 100. An air influx 130 is also able to be included.

In some embodiments, a cable 120 comprises an engineered stainless steel cable which is equal in strength to steel, and is used for shore to shore anchorage or other anchorage. The cable 120 is flexible, easy to handle and uses purpose designed attachment fittings. As an example, a 3¼" "Amstel Blue" cable is rated at 906,000 pounds which is primarily for use on water crossing. It has a specific gravity of 0.9, so it floats. Other types of cable are possible as well such as other steel. In some embodiments, the cable 120 twists in the same direction as the rotation element 100, so that the cable is strengthened rather than unwound by the twisting of the rotation element 100. The cable 120 also couples to a power generator 302 (FIG. 3) which generates power using the rotation of the cable 120 from the rotation of the rotation element 100. Generating power based on rotation is well known in the art.

In some embodiments, the body 102 and the blades 104 comprise hard shells. In some embodiments, the body 102 comprises a hard shell, and the blades 104 are fluid-inflated. In some embodiments, the body 102 and the blades are fluid-inflated. Fluid-inflated means that compartments are filled with a fluid such as water to modify the buoyancy (e.g. spars and ribs in blades are compartmentalized with greater internal water pressure than the water pressure surrounding the blades). The body 102 has double or more layered inflation zones as needed. In embodiments where the body 102 is inflatable, the size of the body 102 is adjustable.

In some embodiments, the rotation element 100 comprises solid materials. In some embodiments, the rotation element 100 comprises solid and flexible materials. In some embodiments, the rotation element 100 comprises flexible materials only. The materials are usable in fluids. In some embodiments, the rotation element 100 comprises neoprene rubberized fabric, Hypalon® fabric or another suitable material, which is fabricated into the designed shape.

In some embodiments, the blades 104 are solid. In some embodiments, the blades 104 are solid with various curves. In some embodiments, the blades 104 are derivatives of 12 meter racing boats. In some embodiments, the blades 104 are solid plastic. In some embodiments, the blades 104 are sails of a fabric which is able to function in two directions. In some embodiments, the blades comprise carbon fiber materials.

The rotation element 100 is coupled to a remote generator 302 (FIG. 3), a pump or a vectoring or direction changing device. The remote generator 302 is able to be located on land, on a pier 464 (FIG. 4), on a floating platform or boat, in a sealed unit located in an emerged condition or another reasonable location and driven by the rotation element 100, with some aid from an anchored element of similar construction.

FIG. 1B illustrates a front view of a buoyancy control system 150. The buoyancy control system 150 includes one or more gas/air tanks 110 and piping/tubing with valves 112, 114, 116 for providing a desired buoyancy of the rotation element 100 (FIG. 1A) by varying the pressure of the gas/air tanks 110. The gas/air tanks 110 are stored in a compartmentalized bladder 108 (FIG. 1A). A standby valve 112 is utilized for recovery of pressure. A preset pressure control valve 114 is able to control the pressure at a preset pressure amount. A valve set 116 is able to release all of the gas/air, if desired. A piston 118 operates to turn pressure valves off and open standby valves to fill the bladder 108 for recovery.

Figure 2A:
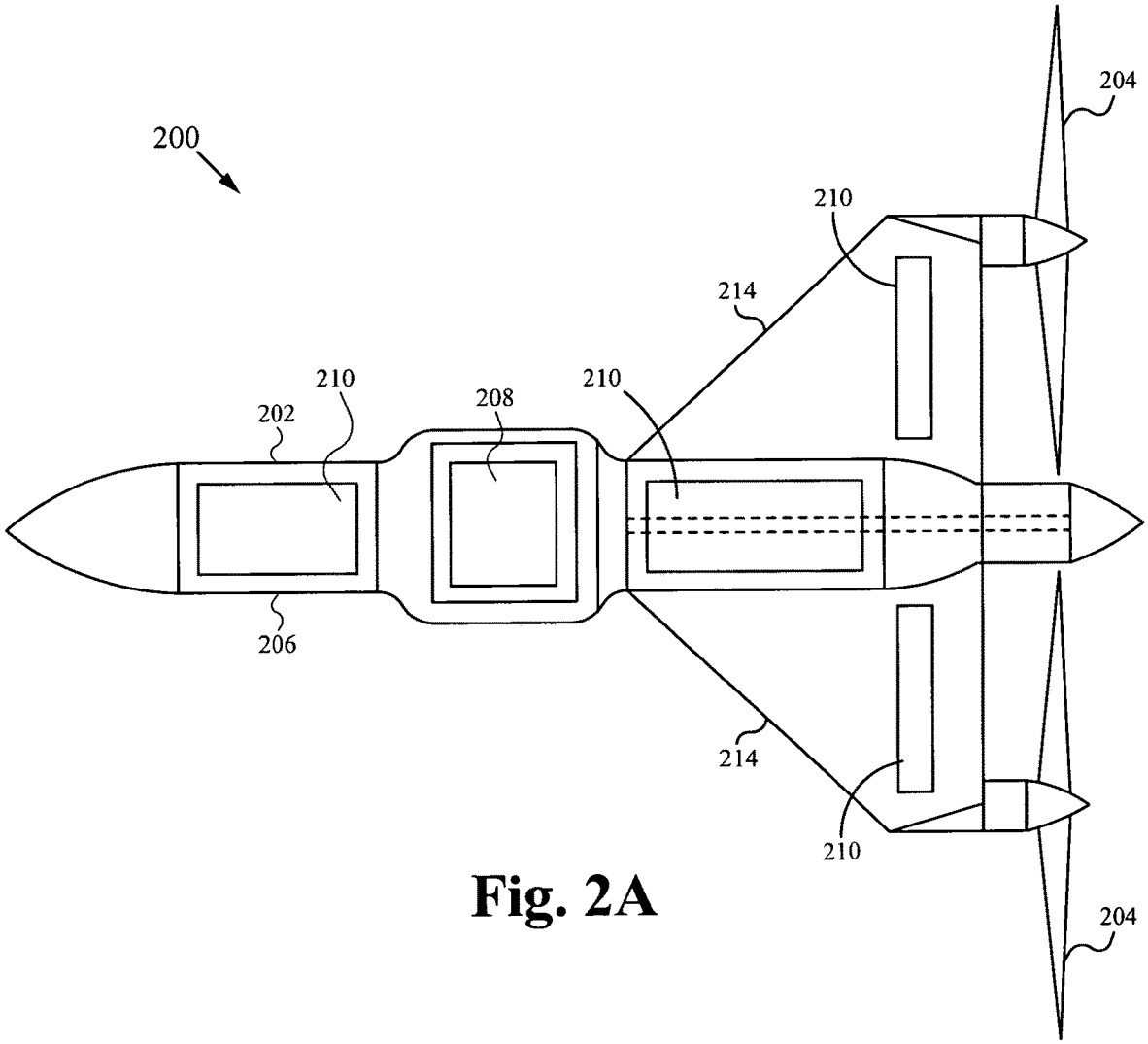
FIG. 2A illustrates a top view of a propeller rotation element of an embodiment in accordance with the apparatus of the present invention.

FIG. 2A illustrates a top view of a propeller rotation element 200 of an embodiment in accordance with the apparatus of the present invention. The propeller rotation element 200 includes a body 202 and one or more propellers 204. The body 202 includes an outer shell 206 and a buoyancy control area which includes one or more compressed gas/air tanks 210. As described above, the one or more compressed gas/air tanks 210 are able to be used to raise or lower the propeller rotation element 200 in the fluid. One or more wings and winglets 214 are coupled to the body 202 to compress the fluid to provide more flow into the one or more propellers 204. The one or more propellers 204 are each coupled to appropriate mechanisms such as a turning shaft which couples to a generator 208 to generate power. In some embodiments, the propellers 204 turn impellers such as Jabsco impellers or Rostok impellers which turn a shaft which generates the power. Any type of power generating mechanism utilizing propellers is able to be included within the propeller rotation element 200. A removable hatch secures the generator 208 in a sealed and waterproof chamber. Furthermore, the compressed gas/air tanks 210 are also contained in removable hatches. In some embodiments, the generator 208 is then coupled to a device to receive and utilize the power as desired. In some embodiments, the blades are neoprene or another material.

Figure 2B:
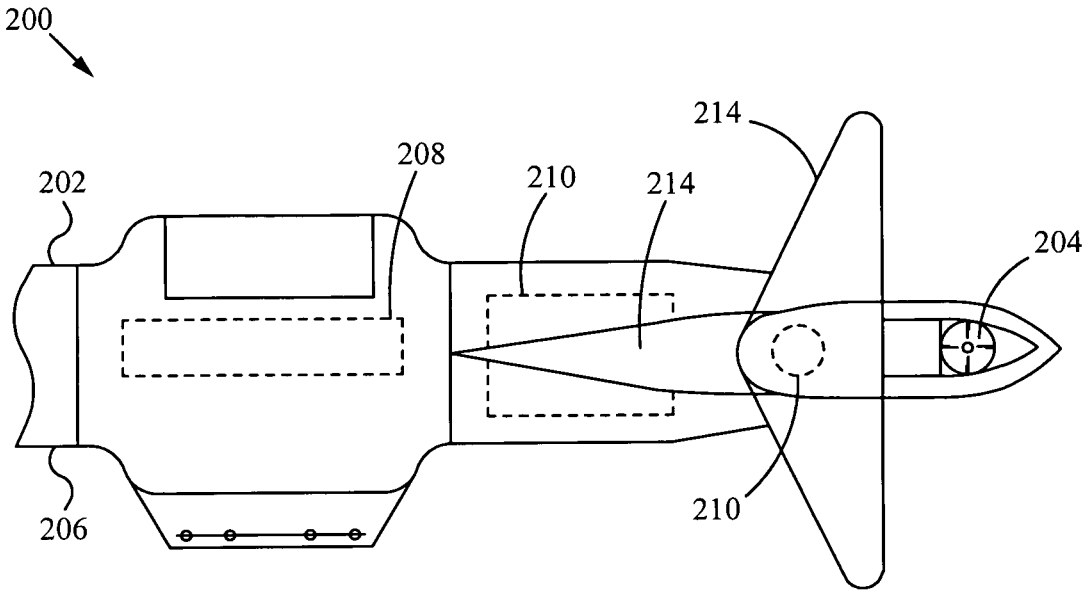
FIG. 2B illustrates a side view of a propeller rotation element of an embodiment in accordance with the apparatus of the present invention.

FIG. 2B illustrates a side view of part of the propeller rotation element 200 of an embodiment in accordance with the apparatus of the present invention. The propeller rotation element 200 includes a body 202 with an outer shell 206 containing a generator 208 and one or more gas/air tanks 210. One or more propellers 204 are coupled to the body 202 and operatively coupled to the generator 208. Wings and winglets 214 are also coupled to the body 202 or are part of the body 202 and are shaped to force water towards the propellers 204 to generator more fluid flow and thus increase power generation.

Figure 3A:
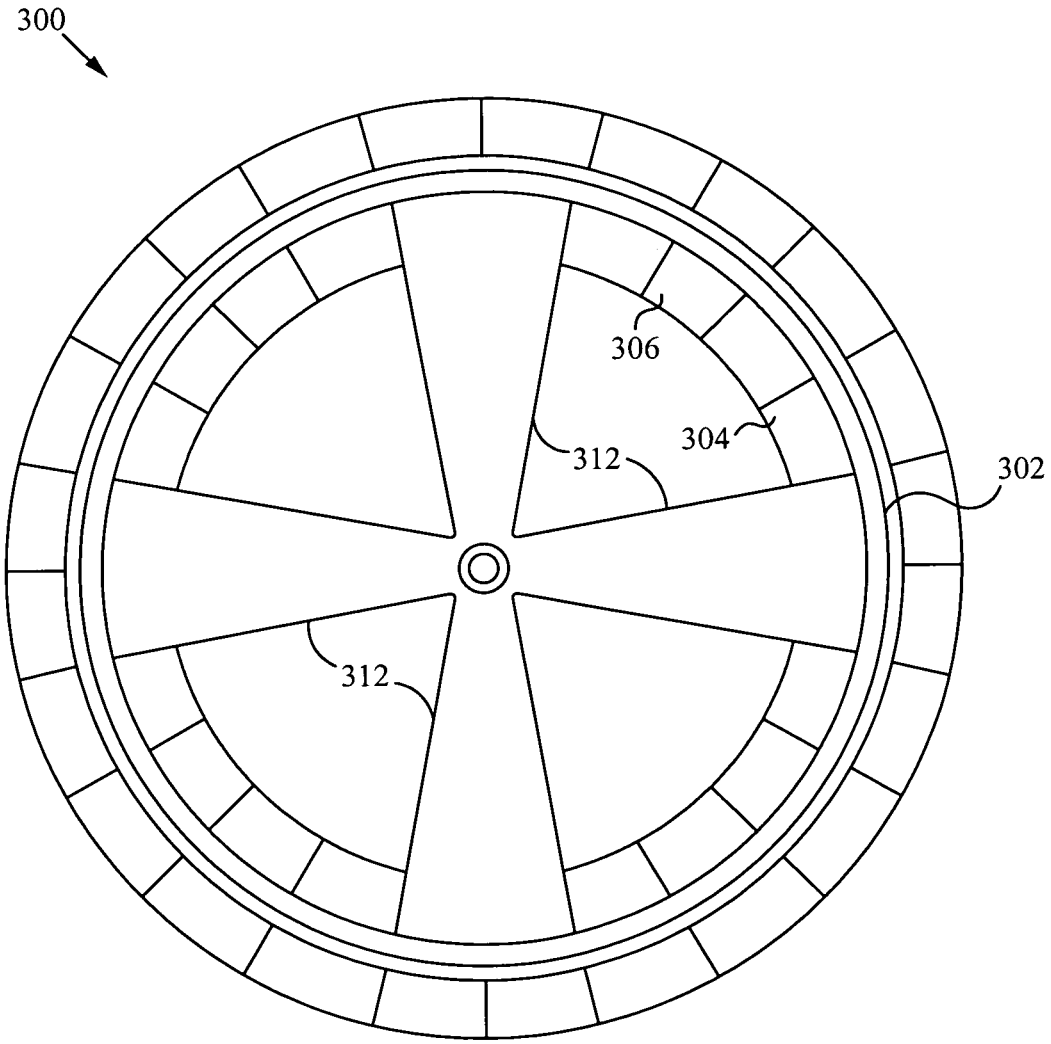
FIG. 3A illustrates a front view of a free wheeling waterwheel rotation element of an embodiment in accordance with the apparatus of the present invention.

FIG. 3A illustrates a front view of a free wheeling waterwheel rotation element 300 of an embodiment in accordance with the apparatus of the present invention. The waterwheel rotation element 300 includes an outer wheel 302 and an inner blade 304 with struts 312 coupled to the outer wheel 302. Each of the outer wheel 302 and the inner blade 304 includes adjustable blades 306. The adjustable blades 306 are able to be adjusted based on the flow of the fluid to increase efficiency of the waterwheel rotation element 300. The blades 306 are able to be adjusted in any manner such as pulling a chain coupled to the blades 306. The angle of the blades 306 is able to be adjusted such that the blades 306 are able to be at 45° or any other appropriate angle.

Figure 3B:
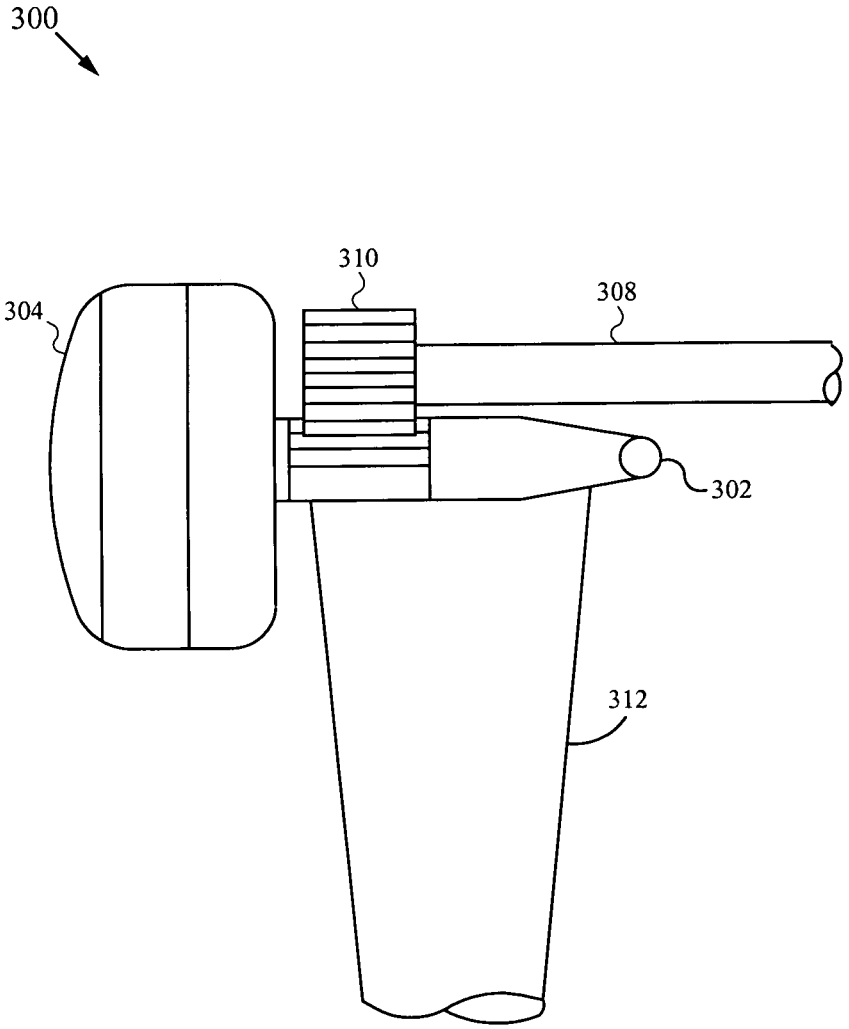
FIG. 3B illustrates a side view of a waterwheel rotation element of an embodiment in accordance with the apparatus of the present invention.

FIG. 3B illustrates a side view of a waterwheel rotation element 300 of an embodiment in accordance with the apparatus of the present invention. When the inner blade 304, the struts 312 and the outer wheel 302 rotate, a shaft 308 rotates which in turn rotates due to the coupling 310 of the shaft and the outer wheel 302. The shaft 308 is coupled to a power generation mechanism. In some embodiments, the power generation mechanism is aboard a boat and the waterwheel rotation element 300 is positioned below the boat. In some embodiments, the waterwheel rotation element 300 is modified as a Pelton Wheel.

Figure 4:
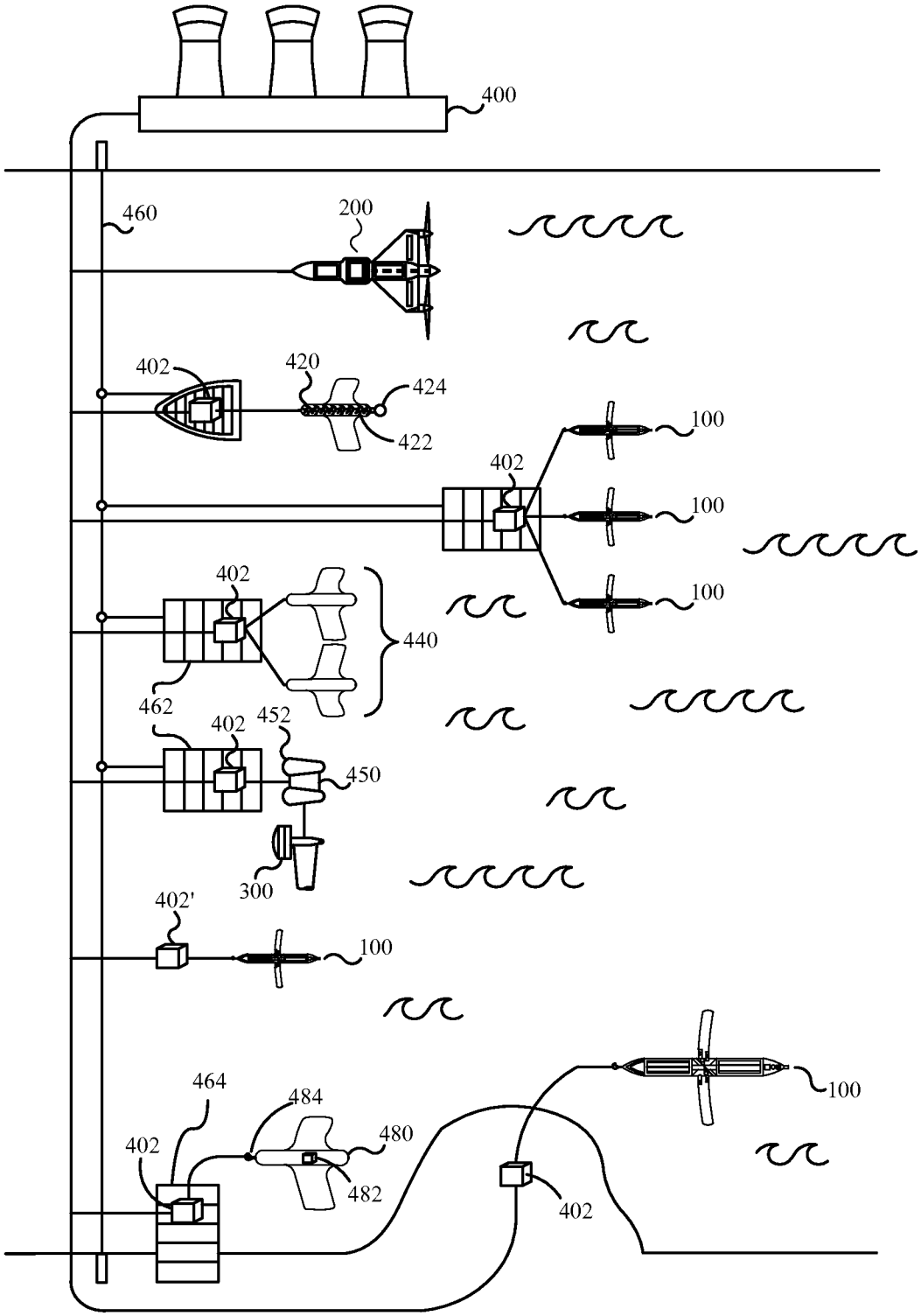
FIG. 4 illustrates a top view of a network of several embodiments of rotation elements and power generators in accordance with the apparatus of the present invention.

FIG. 4 illustrates a top view of a network of several embodiments of rotation elements and power generators in accordance with the apparatus of the present invention. A power plant 400, in some embodiments a preexisting power plant, couples to one or more power generators 402 which each are coupled to one or more rotation elements. The power generators 402 are able to be positioned on floating rafts 462, boats, docks, land or even underwater if modified accordingly. In some embodiments, the floating rafts 462 and boats are coupled to one or more lines 460 which extend across the river. Each power generator 402 is coupled to one or more rotation elements. There are many embodiments of rotation elements, some of which are illustrated in FIG. 4.

A propeller rotation element 200 as described above with reference to FIG. 2 is coupled to a power line since the generator is within the propeller rotation element 200.

A weighted rotation element 420 utilizes foam 422 or another internal component and weights to establish a preselected buoyancy depth (e.g. a foam is used to enable the rotation element 100 to sink to a specified depth such as 50 feet). A weight holder 424 on the weighted rotation element 420 allows additional weight to be added/removed to the weighted rotation element 420 for modifying the depth of the weighted rotation element 420.

A power generator 402, if configured appropriately, is able to couple to multiple rotation elements 100.

A pair of rotation elements 440 are constructed as a pair of devices with one as a left-hand rotation unit and a right-hand rotation unit. The reversal is designed to prevent torque. Multiple pairs are able to be used as well.

A catamaran-type rotation element 450 includes float tubes 452 that remain on top of the water and a waterwheel rotation element 300 which is in the water.

An underwater power generator 402' is able to couple to a rotation element 100. The underwater power generator 402' includes waterproofing and cables as necessary.

A rotation element 100 is coupled to a power generator 402 on land.

A remote controlled rotation element 480 includes a remote control sensor 482 so that valves are able to be operated remotely where compressed air or gas is involved. The pressure operated valves are remotely operated either manually or automatically and serve to aid control. The cable coupled to the remote controlled rotation element 480 contains a ball bearing safety hook 484 which is able to engage and disengage the rotation element as necessary and is capable of holding and moving the rotation element while it is in a rotating mode.

The above examples are not meant to limit the invention in any way. Although specific examples are shown, the different types of rotation elements are able to be coupled to generators located at any location in any appropriate combination. For example, a floating-tip rotation element is able to be coupled to a generator on a boat, land, a dock or wherever. Furthermore, the internal components and any additional components are interchangeable between embodiments as well. Similarly, items such as an additional floating buoy or a ball bearing safety hook are able to be incorporated with any rotation element. For example, although the propeller rotation element is coupled to an anchor, the propeller rotation element is able to be coupled to a floating raft, or a remote controlled rotation element is able to include an additional buoy. Any combination of embodiments is possible. Moreover, more or less power generators and rotation elements are able to be used in a network. Any of the rotation elements are able to be used singularly or in any appropriate combination.

In some embodiments, the rotation element obtains its working shape, strength, reinforcement and designed flotation and rotation inducing elements by being inflated with water or other fluids, or a combination of fluids and flotation inducing devices which will serve to enable the structure to maintain buoyancy-neutral conditions at selected depths. While the inflatable design promises ease, design flexibility and economy in the manufacture and shipping of the smaller inflatable units, as compared to some rigid constructions, situations are able to occur where the latter fabrication technique is able to replace the former inflatable technique. In all instances, the control measures are equally applicable to all construction methods. All rotational items have contours configured to augment designed rotational and stabilizing ability, and the cable attachment design is integrated so as to minimize excessive local stress points, by assuring homogenous tether incorporation. Any of the embodiments is able to be constructed using a variety of components and methods. For example, the rotation element is able to include water inflatable material or a hard cover.

Where desirable, and where preset buoyancy designs are not applicable, alternate on-site buoyancy control through the use of a combination of compressed air or gas, and tether located weights and buoyancy members are able to be used to achieve desired depths. In areas not adjacent to a compressed air supply, an integrated storage tank and related inflatable bladder, remotely controlled, and capable of providing water ballast-control though inflation and/or deflation of its related bladder is able to serve to alter buoyancy as needed. At remote locations, the use of a gas generating unit, also coupled with a bladder, is able to be a stand-alone system or is able to be coupled with a compressed air or other gas supply as desired. All systems described above are able to serve to induce designed operation at varying depths in flowing water.

As described above, the shape of the rotation element is able to be any appropriate shape, including, but not limited to, helical, helical-propeller, propeller only or water-wheel shaped.

Figure 5:
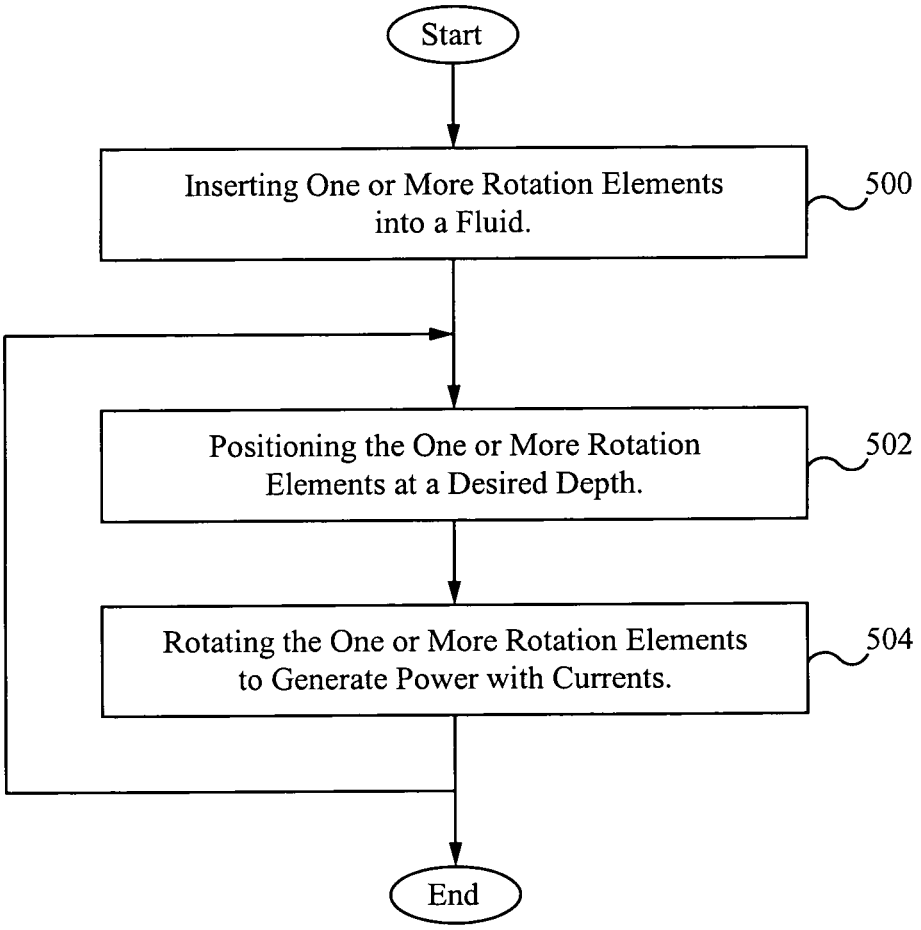
FIG. 5 illustrates a flowchart of a process of generating power utilizing water currents in accordance with the apparatus of the present invention.

FIG. 5 illustrates a flowchart of a process of generating power utilizing water currents. In the step 500, one or more rotation elements are inserted into the water. In the step 502, the one or more rotation elements are positioned at an appropriate depth in the water. In the step 504, the one or more rotation elements rotate and generate power by turning a cable coupled to a power generator. At any appropriate time, each of the rotation elements are coupled to a generator and each generator is coupled to a power plant. The one or more rotation elements are able to be repositioned at a desired depth before, after and while they are rotating. Furthermore, each rotation element is able to be stopped rotating for maintenance, modifications or for other reasons at any time.

Figure 6:
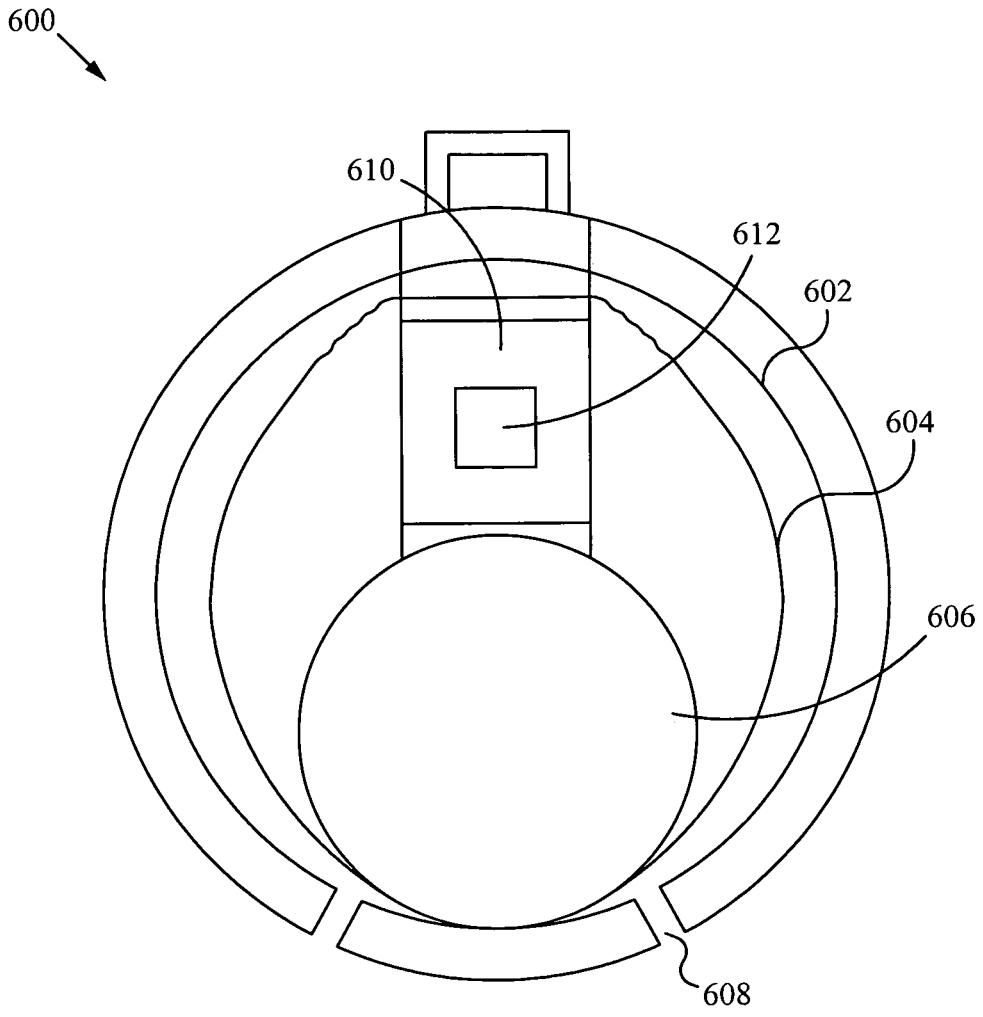
FIG. 6 illustrates a side view of a plastic spherical element of an embodiment in accordance with the apparatus of the present invention.

FIG. 6 illustrates a side view of an alternative embodiment of a spherical element 600 of an embodiment in accordance with the apparatus of the present invention. The spherical element 600 includes a tethered plastic double wall 602 inflated with fluid. A bladder 604 is contained within the double wall 602, and a spherical gas chamber 606 is contained within the bladder 604. The bladder 604 contains any gas including air, and the gas chamber 606 contains any gas including air as well. The spherical element 600 includes one or more vents 608 for releasing water. The spherical element 600 also includes a withdrawable compartment 610 which is able to be a cylinder or any other appropriate shape. The compartment 610 is able to contain instruments 612 which in some embodiments are radio sensitive. The instruments 612 are able to include instrumentation to monitor movement or generate electricity based on the character of the spherical element 600. The spherical element 600 is able to be anchored or used as a free flowing buoy sent to a specific depth.

In some embodiments, electricity is able to be generated from ocean currents such as the Gulf Stream. Multiple units serve a single cable connecting generation to the grid. Heavy costs are involved in all initial phases of this embodiment, but those costs are relatively much smaller than permanent structure proposals. The units are able to be modified for interior electrical procedures.

In some embodiments, the rotation element is located near an existing hydroelectric site. Environmental concerns at existing hydroelectric sites have been addressed and mitigated, for the most part. The rotating unit of most water driven devices moves at relatively slow rates. A helical or helical-propeller design has smooth surfaces and radiused element transitions which will minimize "drag" and any "fish trapping" areas. The shore to shore cables eliminate the need for fixed in stream anchorages and their attendant heavy equipment requirements dependant on road access. The cable provides the flexibility to adjust to a variety of generating equipment and keeps the water course clear of added obstructions. A pressure sensor is also included. Minimizing land-based structures avoids the necessity of road building. The use of high lift helicopters for installation is justified in many instances by the long term nature of the generation capability. Many sites have adjacent areas to facilitate short haul capability. The helicopter approach is the only practical access at some sites.

To utilize the power generation device, one or more rotation elements are placed in a fluid such as a flowing river or ocean transportation, irrigation and other sources and then positioned at an appropriate depth to take advantage of the best current of the water. The one or more rotation elements are coupled to one or more power generators by a cable which are positioned appropriately to function with the rotation elements. As the rotation elements rotate, they turn the cables which in turn rotate components within the power generators to generate power. The power generators are able to be located on floating docks, boats, land, regular docks or anywhere else that is appropriate. When using floating docks or boats, the docks or boats are held in place by a cable extending across the river or another mechanism. The power generators are also coupled to a power plant or something similar to store and utilize the power.

In operation, the rotation element is able to accomplish various tasks. The rotation element is able to drive a remote electrical generator located above water either in a floating vessel, located on land, on a structure based on land or elsewhere. The rotation element is able to be attached to a sealed electrical generator in all environments including both river and tidal situations. In river conditions, the rotation element is able to be attached to a submerged retrievable buoy located at selected depths. In tidal environments, the rotation element is able to be moored between two retrievable buoys at selected depths. The buoys would contain similar operating procedures, lacking rotation only. The design of the tidal rotation element takes into account the fact of left and right hand rotation as tides change from flow to ebb. The only semi-permanent structures are anchorage and attendant shore-based retrieval and service facilities. By using a system of two parallel submerged cables where site conditions warrant, multiple sealed generator units are able to be flexibly tethered between the cables at selected depths. The rotation elements are able to be retrieved for service as appropriate, and there is no need for underwater servicing of electrical equipment. In some tidal locations, similar to the Tacoma Narrows, the rotational units are able to pump water at favorable head conditions to be stored for release into electrical generators rotated by Pelton-type spinners. The water is received either by permanent storage tanks, or by pillow tanks, and the steady release of water to the generator from the tanks would regulate generation, and smooth out the varying and cyclical nature of the tidal flows, allowing a steady flow of electricity. The water pumped at off peak hours is able to create electrical energy to drive pumps elevating water to higher head locations, which would further augment the steady generating capacity of the installation.

The present invention has been described in terms of specific embodiments incorporating details to facilitate the understanding of principles of construction and operation of the invention. Such reference herein to specific embodiments and details thereof is not intended to limit the scope of the claims appended hereto. It will be readily apparent to one skilled in the art that other various modifications may be made in the embodiment chosen for illustration without departing from the spirit and scope of the invention as defined by the appended claims.

What is claimed is:

1. An apparatus for generating power comprising:

a. a body;

b. one or more blades which rotate the body in a fluid in reaction to movement of the fluid, wherein the one or more blades are configured to be demounted, further wherein spars and ribs in the one or more blades are compartmentalized with greater internal water pressure than water pressure surrounding the one or more blades; and c. a plurality of gas tanks coupled to the body, wherein a first gas tank of the plurality of gas tanks is positioned vertically and a second gas tank of the plurality of gas tanks is positioned horizontally.

2. The apparatus of claim 1 wherein the body and the one or more blades are liquid-inflatable.

3. The apparatus of claim 1 further comprising a compressed gas reservoir surrounded by a segregated bladder to alter the depth of the body.

4. The apparatus of claim 1 further comprising a reserve buoy coupled to the body activated remotely for recovery.

5. The apparatus of claim 1 further comprising an anchor for submerging the body.

6. The apparatus of claim 1 wherein the body is coupled to a power generator positioned outside of the fluid.

7. The apparatus of claim 1 wherein the body is coupled to a power generator positioned inside the fluid.

8. The apparatus of claim 1 wherein the body is coupled to a cable attachment which contains an arrangement for engaging and disengaging the body, the cable attachment further for holding and moving the body while the body is in a rotating mode.

9. The apparatus of claim 1 further comprising one or more wings and one or more winglets coupled to the body, wherein the one or more wings and the one or more winglets are configured to force the fluid toward a propeller to increase fluid flow and power generation.

10. A system for generating power comprising:

a. a power generator for generating power positioned outside of a fluid;

b. a first rotation element coupled to the power generator with a first cable, the first rotation element for rotating the first cable due to a motion of the fluid the first rotation element is submerged in, wherein the first rotation element comprises a body and one or more blades and the body and the one or more blades are fluid-inflatable, one or more propellers, and one or more internal generators, wherein the one or more propellers are coupled to the one or more internal generators via a turning shaft, wherein the one or more internal generators are stored in a removable, sealed, waterproof chamber accessible via a removable hatch; and c. a second rotation element coupled to the power generator with a second cable, the second rotation element for rotating the second cable due to the motion of the fluid the second rotation element is submerged in, wherein the second rotation element comprises a second body and a second one or more blades, and the second body and the second one or more blades are fluid-inflatable, further wherein the first rotation element comprises a left-hand rotation unit, and the second rotation element comprises a right-hand rotation unit, wherein the second rotation element further includes a plurality of gas tanks coupled to the second body of the second rotation element, wherein a first gas tank of the plurality of gas tanks is positioned vertically and a second gas tank of the plurality of gas tanks is positioned horizontally.

11. The system of claim 10 wherein the body and the one or more blades are liquid-inflatable.

12. The system of claim 10 wherein the first rotation element utilizes a compressed gas reservoir surrounded by a segregated bladder to alter the depth of the first rotation element.

13. The system of claim 10 further comprising a reserve buoy and line coupled to the first rotation element activated remotely for recovery.

14. The system of claim 10 wherein the first rotation element is coupled to a cable attachment which contains an arrangement for engaging and disengaging the first rotation element, the cable attachment further for holding and moving the first rotation element while the first rotation element is in a rotating mode.

15. A method of generating power comprising:

a. inserting one or more rotation elements into a fluid;

b. positioning the one or more rotation elements in the fluid at a depth; and c. rotating the one or more rotation elements in the fluid which rotate a cable coupled to one or more power generators positioned outside of the fluid, wherein the one or more rotation elements each comprise a body, one or more blades and a plurality of gas tanks, wherein a first gas tank of the plurality of gas tanks is positioned vertically and a second gas tank of the plurality of gas tanks is positioned horizontally, wherein the one or more blades are configured to be adjusted up to a 45° angle, wherein the one or more blades are configured to be demounted, further wherein spars and ribs in the one or more blades are compartmentalized with greater internal water pressure than water pressure surrounding the one or more blades.

16. A network of devices for generating power comprising:

a. one or more floating members;

b. one or more power generators positioned on the one or more floating members, the one or more power generators for generating power;

c. one or more rotation elements coupled to the one or more power generators with one or more cables, the one or more rotation elements for rotating the one or more cables due to a motion of a fluid the one or more rotation elements are submerged in, wherein the one or more rotation elements each comprise a body and one or more blades, and the body and the one or more blades are liquid-inflatable, wherein the body of the one or more rotation elements includes a plurality of double-layered inflation zones, wherein the body of the one or more rotation elements includes a plurality of gas tanks coupled to the body, wherein a first gas tank of the plurality of gas tanks is positioned vertically and a second gas tank of the plurality of gas tanks is positioned horizontally; and d. one or more second rotation elements comprising a body, one or more propellers, and one or more internal generators, wherein the one or more propellers are coupled to the one or more internal generators via a turning shaft, wherein the one or more internal generators are stored in a removable, sealed, waterproof chamber accessible via a removable hatch.

17. A system for generating power comprising:

a. a first power generator located out of water;

b. a first body positioned in a fluid coupled to the first power generator, wherein the first body further comprises an integrated storage tank and inflatable bladder inflatable using a gas generating system coupled with the inflatable bladder, wherein the gas generating system includes compressed air;

c. one or more blades which rotate the first body in the fluid in reaction to movement of the fluid; and d. a plurality of gas tanks coupled to the first body, wherein the plurality of gas tanks alter the depth of the body, wherein a first gas tank of the plurality of gas tanks is positioned vertically and a second gas tank of the plurality of gas tanks is positioned horizontally.

18. The system of claim 17 wherein the first power generator is located on a pier.

19. The system of claim 17 further comprising a second power generator located on a floating dock coupled to a second body with one or more blades positioned in the fluid.

20. The system of claim 19 further comprising a gas insertion mechanism configured to hold a balloon to be released to the surface of the water, wherein the floating dock is coupled to a cable spanning a water course shore to shore.

* * * * *